United States Patent [19]

Ueda

[11] Patent Number: 5,074,085

[45] Date of Patent: Dec. 24, 1991

[54] PANEL FOR USE IN DOUBLE FLOORS

[75] Inventor: Yoshimi Ueda, Fukui, Japan

[73] Assignee: Fukuvi Chemical Industry Co., Ltd, Fukui, Japan

[21] Appl. No.: 615,576

[22] Filed: Nov. 19, 1990

[30] Foreign Application Priority Data

Mar. 20, 1990 [JP] Japan ..... 2-28507[U]

[51] Int. Cl.[5] ..... E04B 5/00

[52] U.S. Cl. ..... 52/126.6; 52/220; 52/126.1; 248/916

[58] Field of Search ..... 52/220, 221, 126.6, 52/263, 126.1, 126.2, 126.5, 298, 296, 297; 248/188.5, 916; 403/282, 345, 360

[56] References Cited

U.S. PATENT DOCUMENTS

| | | | |
|---|---|---|---|
| 3,295,272 | 1/1967 | Kanno | 52/126.6 |
| 3,645,054 | 2/1972 | Olvera | 52/126.6 |
| 4,270,458 | 6/1981 | Schwartzkopf | 52/126.6 X |
| 4,736,555 | 4/1988 | Nagare et al. | 52/126.6 |
| 4,843,792 | 7/1989 | Regers et al. | 52/126.5 X |
| 4,914,875 | 4/1990 | Gustafson | 52/126.6 |

*Primary Examiner*—David A. Scherbel
*Assistant Examiner*—Robert J. Canfield
*Attorney, Agent, or Firm*—Kane Dalsimer Sullivan Kurucz Levy Eisele and Richard

[57] ABSTRACT

A panel is disclosed for use in double floors, a number of attachment holes are formed in the rear surface of the panel main body. The leg parts fit into these attachment holes in a state in which a step on the outer circumference of a leg part faces the panel main body. An elastic ring is placed between the step of a leg part and the panel main body. Projections, which are deformed when a leg part is inserted into an attachment hole of the panel main body and which fill the gap between the outer circumference of the leg part and the inner surface of the attachment hole, are formed on the outer circumference of the leg parts.

3 Claims, 10 Drawing Sheets

PANEL FOR USE IN DOUBLE FLOORS

FIELD OF THE INVENTION

This invention relates to a double-floor construction for the purpose of installing wiring beneath a floor, as well as to double-floor panels used in the construction thereof.

BACKGROUND ART

Recently, various types of electronic devices for office automation and the like have been installed, especially in offices and so forth. The installation of the wiring for these electronic devices is generally carried out separately from the interior construction, so that the simplest installation method involves the use of cables lying on the surface of the floor. However, &he laying of a number of cables on the surface of the floor leads to an unsightly appearance and decreases safety, so that such installation is inconsistent with the attainment of an ideal office or living space, which has been recently increasingly in demand.

This installation can also be carried out by using two layers in the construction of the floor and installing theses cables beneath the upper floor surface. Conventionally, the construction of such double floors is such that alterations to the walls or floor foundation are not necessary; in other words, a number of legs are formed on the rear surface with a fixed spacing, and above this panels are laid closely together to form the floor.

However, since the legs of the panels used conventionally for the construction of such double floors are formed integrally with the panel bodies, the length of the legs cannot be changed without changing the whole of the panel, so that the changing of the floor height, for example when the number of cables increases, involves a great deal of labor. Furthermore, if unevennesses exist in the surface below the floor, corresponding unevennesses may be formed in the floor surface constructed above this, so that the underlying surface must be leveled and unevennesses removed.

It might be thought that simply by making the legs freely detachable from the panels, thus allowing their length to be altered, this type of problem could be solved. However, in this case, the problem of "instability" or "creaking" occurs as a result of play in the attaching elements, and the altering of the length of the legs cannot be easily accomplished.

Furthermore, in this type of double floor, and especially in the case in which the width (space from wall to wall) or shape of the floor surface is peculiar, it is difficult to lay panels of standardized dimensions over the whole floor surface without leaving gaps. Conventionally, other materials having the same height as the panels have been used to fill in at the floor edges.

These materials used to fill in at the edges of the floor surface must be fitted to the existing gaps at the site in the proper dimensions and form; there is a particular problem in that the creation and installation of these materials in cases in which their shape is complex, as when there is a pillar protruding from a wall surface or the like, takes a great deal of work.

In addition, the method of determining the strength of such panels for double floors is conventionally such that the strength is set in correspondence with an area load calculated on the basis of the largest weight by area among the machines to be placed on the floor; panels possessing this degree of strength are used over the entire surface of the floor.

As a result of this, especially when heavy items are to be placed on the floor, since high-strength panels are used over the entire floor surface, the cost of constructing the double floor is very high.

SUMMARY OF THE INVENTION

It is an object of the present invention to provide double-floor panels which allow the easy individual adjustment of legs and adjustments which change the height of the floor and compensate for unevennesses in the underlying surface (ground adjustment), as well as allowing the construction of a double floor without the problems of "instability" or "creaking".

Furthermore, it is an object of the present invention to provide a double floor which can be constructed easily using only panels of standard fixed dimensions and at the lowest possible cost.

In accordance with the double-floor panels of the present invention, the leg parts comprising the legs of the panels can be freely detached, so that by causing these leg parts alone to change in length, the height of the floor can be easily changed. Furthermore, by altering the length of individual leg parts independently in correspondence with the unevennesses of the surface underlying the floor, or by changing the width or number of elastic rings, ground adjustments can be easily made by slight length adjustments of individual legs.

Moreover, in the panels which are so constructed that the leg parts are fitted into the panel main body, protrusions formed in the leg parts fit into a gap, and elastic rings absorb the impact, so that "instability" or "creaking" is eliminated and the double floor so constructed has desirable sound-dampening effects.

Furthermore, in the panels which are so constructed that the leg parts are screwed into the panel main body, by rotating the leg parts, the length of each leg can be individually changed in a non-step manner, and it is possible to change the height of the floor and make ground adjustments without removing the legs. Moreover, the operation of rotating these legs can be easily accomplished from the upper side of the floor using a connecting groove in the leg parts by means of a driver inserted through the medium of access holes formed in the panel main body. Therefore, the changing of the height of the floor can be accomplished without lifting the panels which are laid on the floor, and as the operation can be carried out while checking the state of the floor surface (the degree to which it is level), this represents an improvement.

In accordance with a double floor having support parts of the present invention the panels positioned at the edges of the floor surface are cut in correspondence with the size or form of the floor surface, so that it is possible to construct the entire floor surface using panels with fixed dimensions. In addition, where legs are partially removed by means of this cutting, support parts are installed in place of these legs, so that all panels are stable and, moreover, installed with a strength corresponding to the weight load per area. Furthermore, the height of the support parts can be easily adjusted by rotating their pipe bodies and thus moving them up and down, so that they can easily be installed as replacements for the legs which were removed. Accordingly, using only panels and support parts which can be prefabricated in large quantities at a factory, double floors of a certain size or form can easily be constructed.

Furthermore, according the present invention, a double floor composed of a plurality of panels with differing strengths spread closely together, it is possible to use high-strength panels only where heavy objects are placed. As a result, this method of panel strength allotment eliminates places at which there is excess panel strength, and thus it is possible to keep the cost of materials at the lowest limit possible. In addition, since the panels are differentiated by color according to strength, if the panels are laid in the appropriate positions after their strength has been identified by color, mistakes in the selection and laying of panels are eliminated. Furthermore, even after the construction of a double floor, the strength of each panel comprising the floor can be checked by color; thus the mistaken placement of a heavy object on a low-strength panel can be prevented and when the rearrangement of heavy objects takes place, it is possible to determine at a glance whether or not rearrangement of &he panels is also necessary.

BRIEF DESCRIPTION OF THE DRAWINGS

FIG. 1 is a plan view of a double-floor panel. FIG. 2 is a side view of a double-floor panel. FIG. 3 is a cross-sectional view of a leg of a double-floor panel. FIG. 4 is a plan view of a leg part. FIGS. 5 and 6 are side views of leg parts. FIG. 7 is a plan view of a rubber pad. FIG. 8 is a side view of a rubber pad.

FIG. 9 is a plan view of a double-floor panel. FIG. 10 is a side view of a double-floor panel. FIG. 11 is a cross-sectional view of a leg of a double-floor panel. FIG. 12 is a plan view of a leg part. FIG. 13 is a side view of a leg part. FIG. 14 is a plan view of a rubber pad. FIG. 15 is a side view of a rubber pad.

FIG. 19 is an angled view showing the overall construction of a double floor. FIG. 20 is a cross-sectional view taken along X in FIG. 19. FIG. 21 is an angled view seen from above a support part. FIG. 22 is an angled view seen from below a support part.

FIG. 23 is a plan view of a panel. FIG. 24 is a side view of a panel. FIGS. 25 and 27 are plan views of rubber pads. FIGS. 26 and 28 are side views of rubber pads.

DETAILED DESCRIPTION OF THE PREFERRED EMBODIMENTS

First, panel 1, which is a preferred embodiment of a double-floor panel with a construction in which leg parts are fitted into the panel main body, will be explained.

Figure 1:
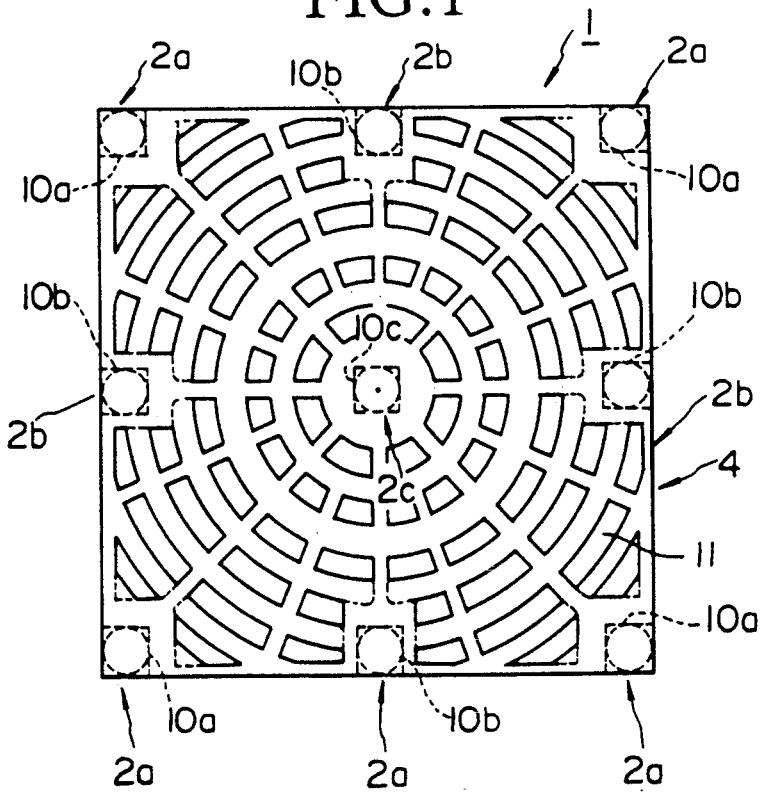
FIGS. 1 to 8 are for the purpose of explaining the double-floor panels which are so constructed that leg parts are fitted into the panel main body.
Figure 2:
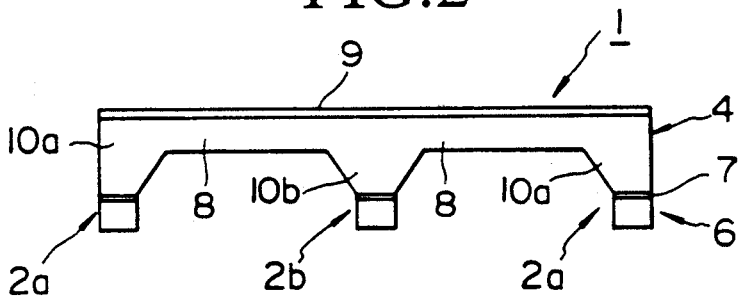
Figure 3:
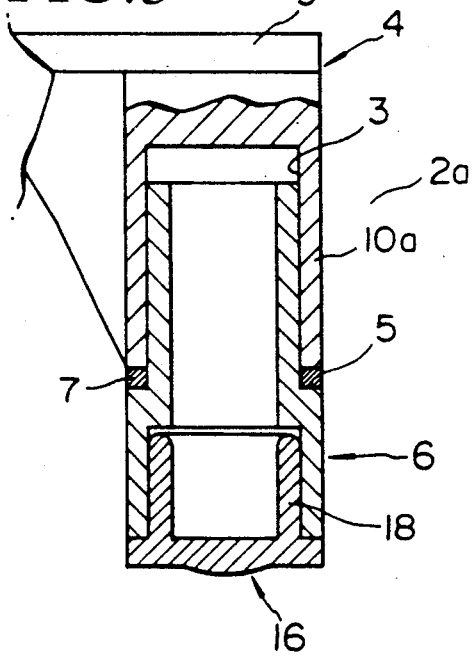

As shown in FIGS. 1, 2, and 3, panel 1 is comprised of:

panel main body 4, in the reverse side of which a plurality of attachment holes 3 are formed at regular intervals, leg parts 6, which have a pole shape and steps 5 formed in the peripheral portion thereof, one end of which is fitted into attachment holes 3 with step 5 facing panel main body 4, and elastic rings 7, which are placed around the circumference of each leg part 6 and are inserted between step 5 and panel main body 4.

In addition, legs 2*a*, 2*b*, and 2*c* are comprised of pipe-shaped parts 10*a*, 10*b*, and 10*c*, within which attachment holes 3 are formed, and said leg parts 6, which are attached to these.

As shown in FIGS. 1 and 2, panel main body 4 is comprised of a plate 9, in the rear surface of which a plurality of ribs 8 are formed, and pipe-shaped parts 10*a*, 10*b*, and 10*c*, which are formed in the center and on the edge of plate 9 so as to extend to the rear-surface side; a plurality of arc-shaped slits 11 are formed in the upper surface (of plate 9), and within pipe-shaped parts 10*a*, 10*b*, and 10*c*, attachment holes g with a circular cross-section are formed.

This plate body 4 has standardized dimensions so as to allow large-scale prefabrication at factories; such dimensions being for example 250 mm on a side and a height of 45 mm.

Figure 4:
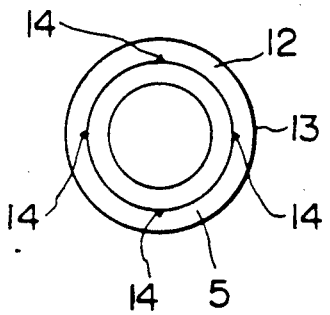
Figure 5:
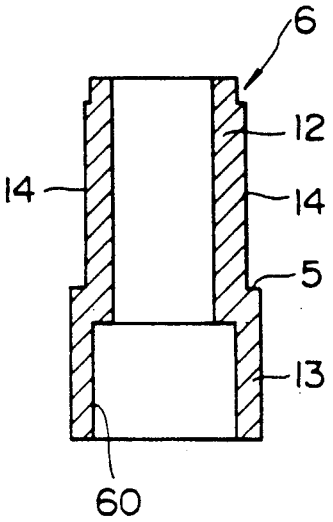

As shown in FIGS. 4 and 5, leg parts 6 are comprised of cylindrical parts 12, which fit into attachment holes 2 with a very small gap, and cylindrical parts 13, which are formed as extensions of cylindrical parts 12, with a larger outer diameter than that of cylindrical parts 12; at the boundary of these cylindrical parts 12 and 13, step 5 is formed. Furthermore, the inner diameter of cylindrical parts 13 is identical to that of attachment holes 3, and it is possible to fit a leg part 6*a* which is identical to a leg part 6 or a rubber pad 16 or 17 described hereinbelow into attachment hole 60.

In addition, as shown in FIG. 4, a plurality (in this case, four) of projections 14, which are deformed by the insertion of cylindrical part 12 into attachment hole 3 and fill in the gap between the outer circumference of cylindrical part 12 and the inner surface of attachment hole 3, are formed on the outer circumference of cylindrical part 12. These projections 14 are triangular in cross-section and are positioned on the outer circumference of cylindrical part 12 at equal spacing so that they extend in an axial direction.

As stated above, these projections 14 should be very small, so that they deform at the time of insertion and fill in the gap mentioned above; for example, a height of roughly 0.2 mm is sufficient. Furthermore, it is desirable to use PP (polypropylene) resin or the like as the material for panel main body 4 and leg parts 6; however, it is desirable to use, for leg parts 6, a material which has a lower degree of hardness than that of the material used for panel main body 4, so that projections 14 are easily deformed.

Furthermore, elastic ring g is made of a material such as rubber or the like which offers sufficient elasticity; its inner diameter is somewhat larger than that of cylindrical part 12, and its rectangular cross-section is determined so that the outer diameter is equal to that of cylindrical part 13.

Figure 16:
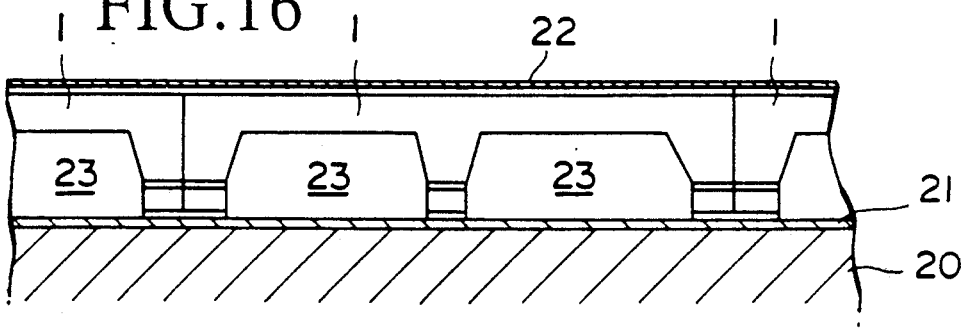
FIG. 16 is a horizontal cross-sectional view of a double floor built using panels which are so constructed that leg parts are fitted into the panel main body.

By using panels 1 constructed as described above, the construction of a double floor as shown in FIG. 16 can be accomplished.

First, a sheet 21 is laid on the surface 20 beneath the floor and affixed thereto, and then panels 1, on which legs 2*b* and 2*c* have rubber pads 16 attached, are connected by means of the attachment of rubber pad 17 to legs 2*a*, and are laid closely together on top of sheet 21 through the medium of rubber pads 16 and 17.

Figure 7:
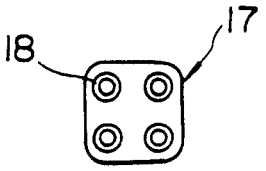
Figure 8:
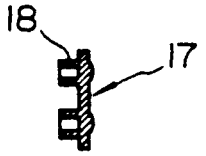

Sheet 21 is made of polyethylene foam and absorbs small unevennesses in the ground 20 beneath the floor. Furthermore, rubber pads 16 and 17 are made of resins having elasticity, and as shown in FIGS. 3, 7, and 8, these pads have on their upper surfaces a fixed number of projections 18 which fit into cylindrical parts 13 of leg parts 6. In other words, rubber pad 16 has one projection 18, while rubber pad 17 has four projections at fixed spacing; these four projections 18 fit into legs 2*a* of the four adjoining panels 1.

When the laying operation is carried out, in the case of large unevennesses in the ground 20 beneath the floor which can not be absorbed by sheet 21, this can be absorbed by for example making an elastic ring 7 thicker or by increasing the number thereof, thus lengthening the leg 2*a* of panel 1 which is positioned in a cavity and absorbing the unevenness.

Furthermore, in order that legs 2*a*, 2*b*, and 2*c* of panel 1 do not disturb the paths of cables which are to be disposed within the floor, when the position (arrangement) when laid of each panel 1 is set and the laying of panels 1 carried out, base lines are drawn on sheet 21. By using these lines, the problem is easily avoided.

Next, a flooring material 22 is attached to the upper surface of the panels 1 laid in this manner, and the operation thus completed.

In accordance with a double floor constructed by means of these panels 1, it is possible to dispose cables and the like in the space 23 created beneath panels 1 and thus place wire beneath the floor. Moreover, in this floor construction, since the gap left by the part of leg part 6 which fits into panel 1 is filled by projections 14, panel 1 becomes stable. In addition, as elastic ring 7, rubber rings 16 and 17, and sheet 21 have shock-absorbing functions, superior sound-dampening qualities can be realized, and a surface which is easy to walk on and free from "instability" or "creaking" can be provided.

When a change in the height of space 23 or the height of the floor surface is desired, by exchanging leg parts 6 for ones with different dimensions, or by changing the thickness or the number of elastic rings 7, the length of the legs of panels 1 can be changed in a step manner or can be finely adjusted.

Figure 6:
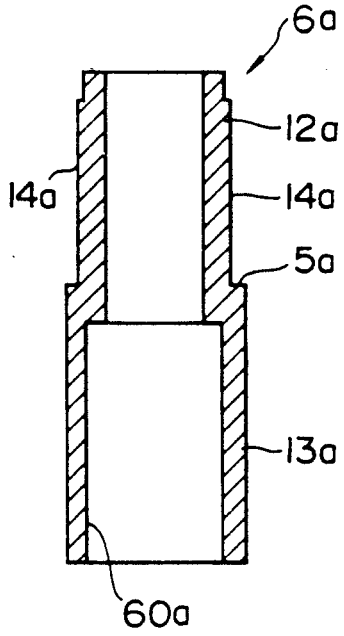

For example, when an increase in the height of the floor is desirable, an extended leg part 6*a* such as that shown in FIG. 6 can be used, or cylindrical parts 12 and 13*a* or cylindrical parts 12*a* and 13 can be fitted together, extending leg parts 6 and 6*a*, and they can then be connected to pipe-form parts 10*a*, 10*b*, and 10*c*. When leg parts 6 or leg parts 6*a* are extended a number of times, it is desirable to insert materials like flexible rings 7 in the spots of protrusion at steps 5 and 5*a*.

By means of the panels 1 explained above, the following effects can be obtained.

In other words, the leg parts 6 comprising legs 2*a*, 2*b*, and 2*c* of panel 1 can be freely detached, so that by changing solely these legs 6 to different lengths, the height of the double floor made from these panels 1 can be easily changed.

Furthermore, in correspondence with unevennesses in the ground 21 beneath the floor, the length of each leg part 6 can be set independently, or the thickness or number of elastic rings 7 can be changed, and by means of this, when slight adjustments are made in the length of the individual legs, adjustment (ground adjustment) which absorbs the unevennesses present during the laying of the floor can be easily accomplished.

Moreover, by means of these panels 1, the protrusions formed in leg parts 6 fill in the gaps in areas of insertion of leg parts 6, and the elastic rings 7 absorb shock, so that "instability" and "creaking" are eliminated, and a double floor having excellent sound-dampening characteristics can be constructed.

Next, panel 31, which is a preferred embodiment of a double-floor panel with a construction in which leg parts are screwed into the panel main body, will be explained with reference to FIGS. 9–15, 17, and 18.

Panel 31 is comprised of:

panel main body 34, in the reverse side of which a plurality of attachment holes 33 are formed at regular intervals, leg parts 36, which have a pole shape and steps 35 formed in the peripheral portion thereof, one end of which is fitted into attachment holes 33 with step 35 facing panel main body 34, and elastic rings 37, which are placed around the circumference of each leg part 36 and are inserted between step 35 and panel main body 34. In addition, legs 32*a*, 32*b*, and 32*c* are comprised of pipe-shaped parts 40*a*, 40*b*, and 40*c*, within which attachment holes 33 are formed, and said leg parts 36, which are attached to these.

Figure 9:
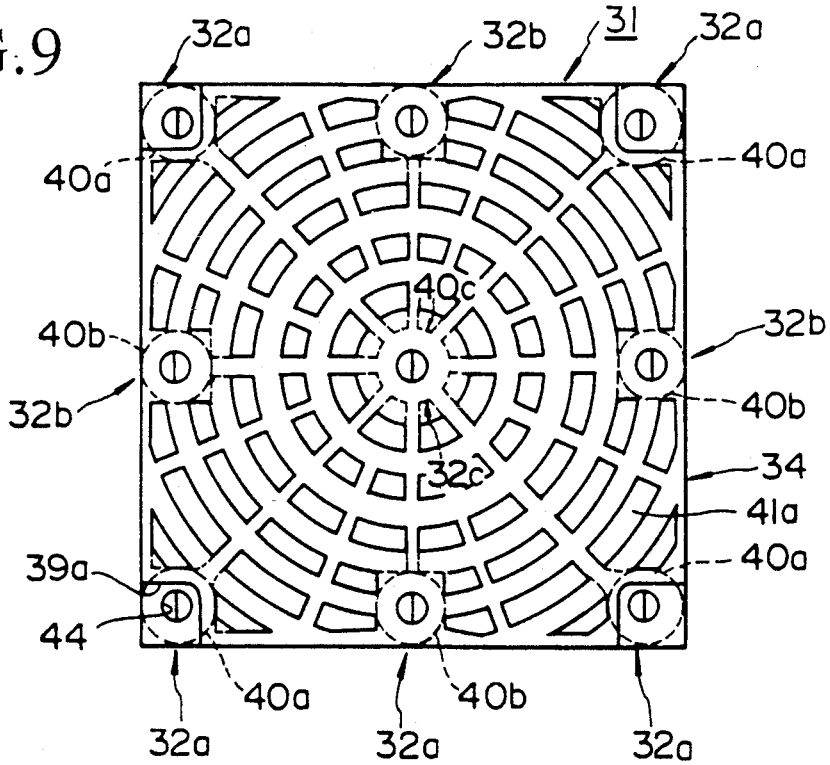
FIGS. 9 to 15 are for the purpose of explaining the double-floor panels which are so constructed that leg parts screw into the panel main body.
Figure 10:
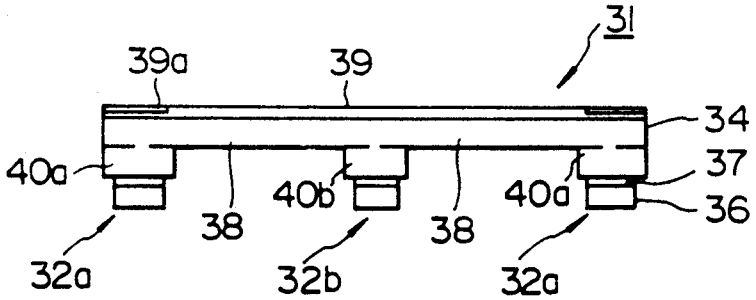

As shown in FIGS. 9 and 10, panel main body 34 is comprised of a plate 39, in the rear surface of which a plurality of ribs 38 are formed, and pipe-shaped parts 40*a*, 40*b*, and 40*c*, which are formed in the center and on the edge of plate 39 so as to extend to the rear-surface side; a plurality of arc-shaped slits 41*a* are formed in the upper surface (of plate 39), and within pipe-shaped parts 40*a*, 40*b*, and 40*c*, attachment holes 33 with a circular cross-section are formed. Furthermore, access holes 44, for the insertion of the screwdriver used in connecting groove 41 described hereinafter, are formed positioned above the axes of cylindrical parts 40*a*, 40*b*, and 40*c*, and in the four corners depressions 39*a* are formed, into which rubber parts 47 described hereinafter are fitted.

This panel main body 34 is made of PP (polypropylene) resins or the like, and has standardized dimensions, as in the case of the panel main body 4 above.

Figure 12:
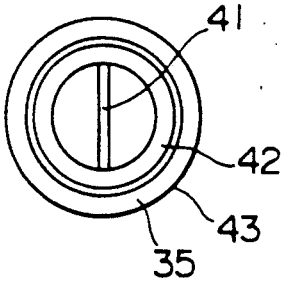
Figure 13:
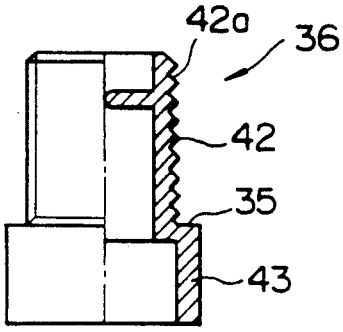

As shown in FIGS. 12 and 13, a leg part 36 comprises a pipe-shaped part 42, which is screwed into an attachment hole 33 through the medium of a cylindrical part 45, and a pipe-shaped part 43, which is formed as an extension of this pipe-shaped part 42 and has an outer diameter which is larger than that of the pipe-shaped part 42; at the boundary of these pipe-shaped parts 42 and 43, step 35 is formed. Furthermore, the inner diameter of this pipe-shaped part 43 is so set that a rubber pad 46 can be fitted into and attached to it. In addition, a connecting groove 41 for the purpose of tools such as screwdrivers or the like is formed in the surface of the end of leg part 36 that screws into attachment hole 33. Screw hole 45*a*, into which screw thread 42*a* which is formed on the outer circumference of pipe-shaped part 42 is screwed, is formed on the inner surface of cylindrical part 45; this is fixed within attachment hole 33.

Furthermore, it is possible to use PP (polypropylene) resins or the like as the material for leg part 36 or cylindrical part 45, but it is acceptable, in view of the durability of the screw thread, to use metal as the material for cylindrical part 45, for example.

Furthermore, elastic rings 37 are, as in the case of the elastic rings 7 mentioned above, made of a material which provides sufficient elasticity, such as rubber or the like, and have a rectangular cross-section.

Figure 17:
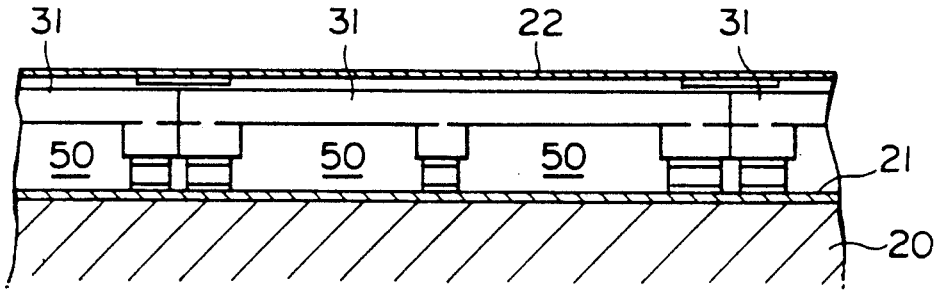
FIG. 17 is a horizontal cross-sectional view of a double floor built using panels which are so constructed that leg parts screw into the panel main body.
Figure 18:
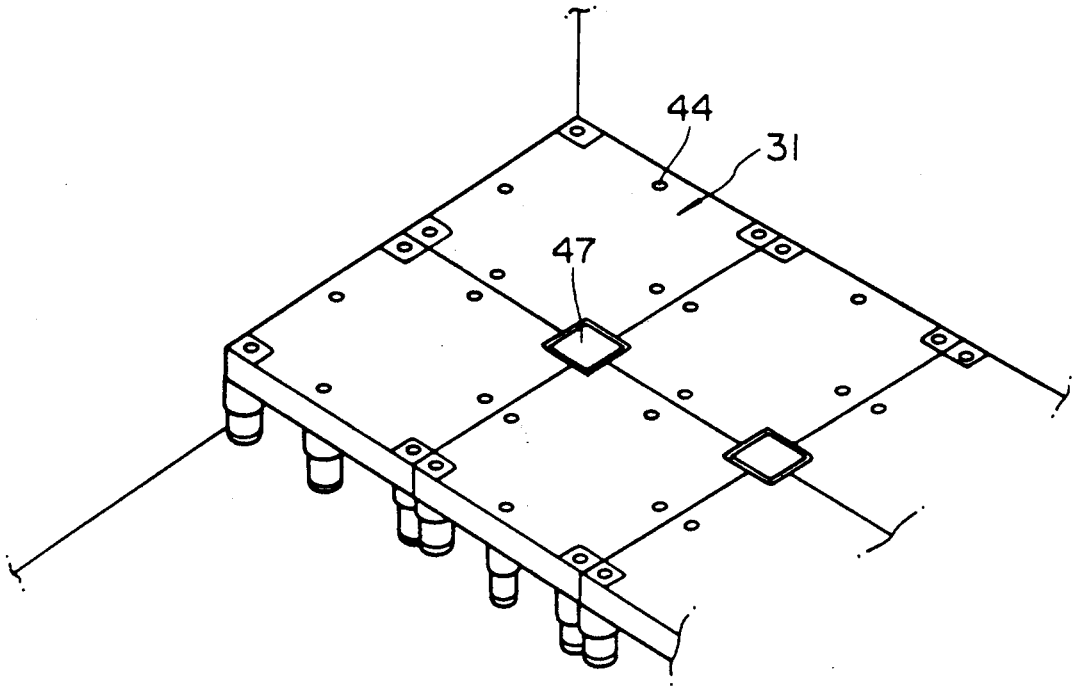
FIG. 18 is an angled view of this double floor.

By using panels 31 constructed in the above manner, a double floor such as that shown in FIG. 17 can be easily constructed in the manner given below.

First, a sheet 21 is laid on the surface 20 beneath the floor and affixed thereto, and then panels 31, on which legs 32*a*, 32*b* and 32*c* have rubber pads 46 attached, are connected by means of the attachment of rubber part 47 to access holes 44, and are laid closely together on top of sheet 21 through the medium of rubber pad 46.

Figure 11:
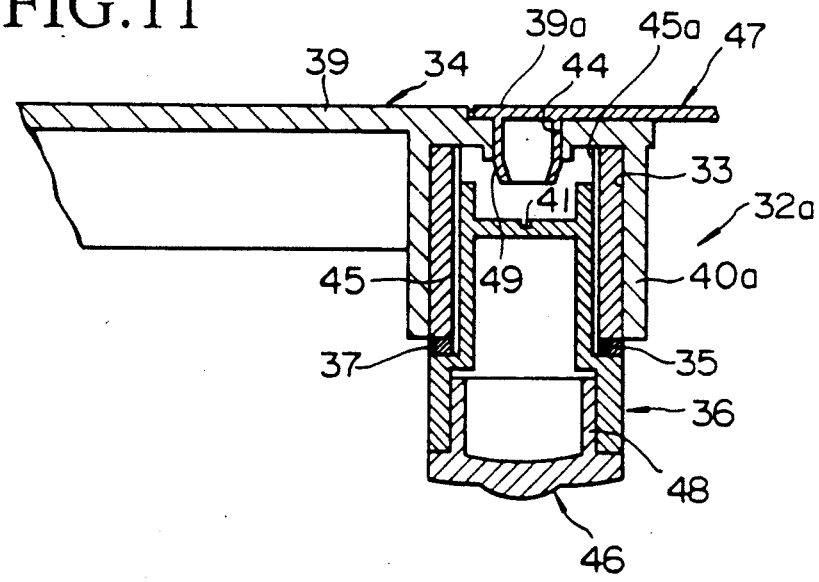

Rubber pad 46 is made of a resin having flexibility, and as shown in FIG. 11, has on its upper surface a projection 48 which fits into pipe-shaped part 43 of leg part 36.

Figure 14:
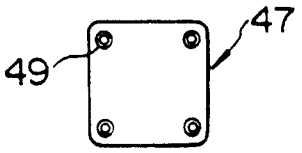
Figure 15:
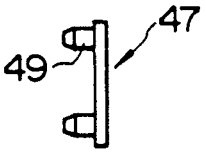

Furthermore, as shown in FIGS. 11, 14, and 15, rubber part 47 has on its upper surface four projections 49, which are separated by fixed spaces and which fit into access holes 44; these four projections 49 fit into four access holes 44 of the four adjoining panels 31.

When the laying operation is carried out, in the case of large unevennesses in the ground 20 beneath the floor which can not be absorbed by sheet 21, this can be absorbed by rotating leg parts 36 and for example lengthening a leg of a panel 31 which is positioned in a depression. The rotation of this leg part 36 can be accomplished easily using connecting groove 41 by means of a tool such as a screwdriver or the like inserted through the medium of an access hole 44 positioned in the upper surface of the floor; rubber part 47 may first be removed if necessary.

Next, as in the case of panels 1 mentioned above, a flooring material 22 is laid on the upper surface of the panels 31 laid in this manner, and the installation thus completed.

In accordance with a double floor constructed by means of these panels 31, it is possible to dispose cables and the like in the space 50 created beneath panels 31 and thus place wire beneath the floor, as in the case of the panels 1. In addition, superior sound-dampening qualities can be realized, and a surface which is easy to walk on and free from "instability" or "creaking" can be provided.

When a change in the height of space 50 or the height of the floor surface is desired, by rotating leg parts 36, the length of the legs can be changed in a smooth manner.

In accordance with the panels 1 explained above, the following effects are obtained.

In other words, by means of the rotation of leg parts 36, the length of the legs can be individually changed in a smooth manner, so that changes in the height of the floor or ground adjustments Can be accomplished.

Moreover, the rotation of a leg part 36 can be accomplished easily using connecting groove 41 by means of a tool such as a screwdriver or the like inserted through the medium of an access hole 44 positioned in the upper surface of the floor. As a result, it is possible to change the height of the floor without taking up the panels, and ground adjustments can be carried out while checking the state of the floor surface (degree to which the surface is level), so that these operations can be conducted easily.

Furthermore, according to these panels 31, the connection of these panels 31 at the time of the installation of a double floor can be carried out from the upper-surface side by means of rubber parts 47 which are attached to the upper surface of the panels, so that it is possible to connect the panels 31 after they have been laid, and installation becomes a simple matter.

Next, a preferred embodiment of a double floor having a construction in which support parts are used will be explained with reference to FIGS. 19–28.

Figure 19:
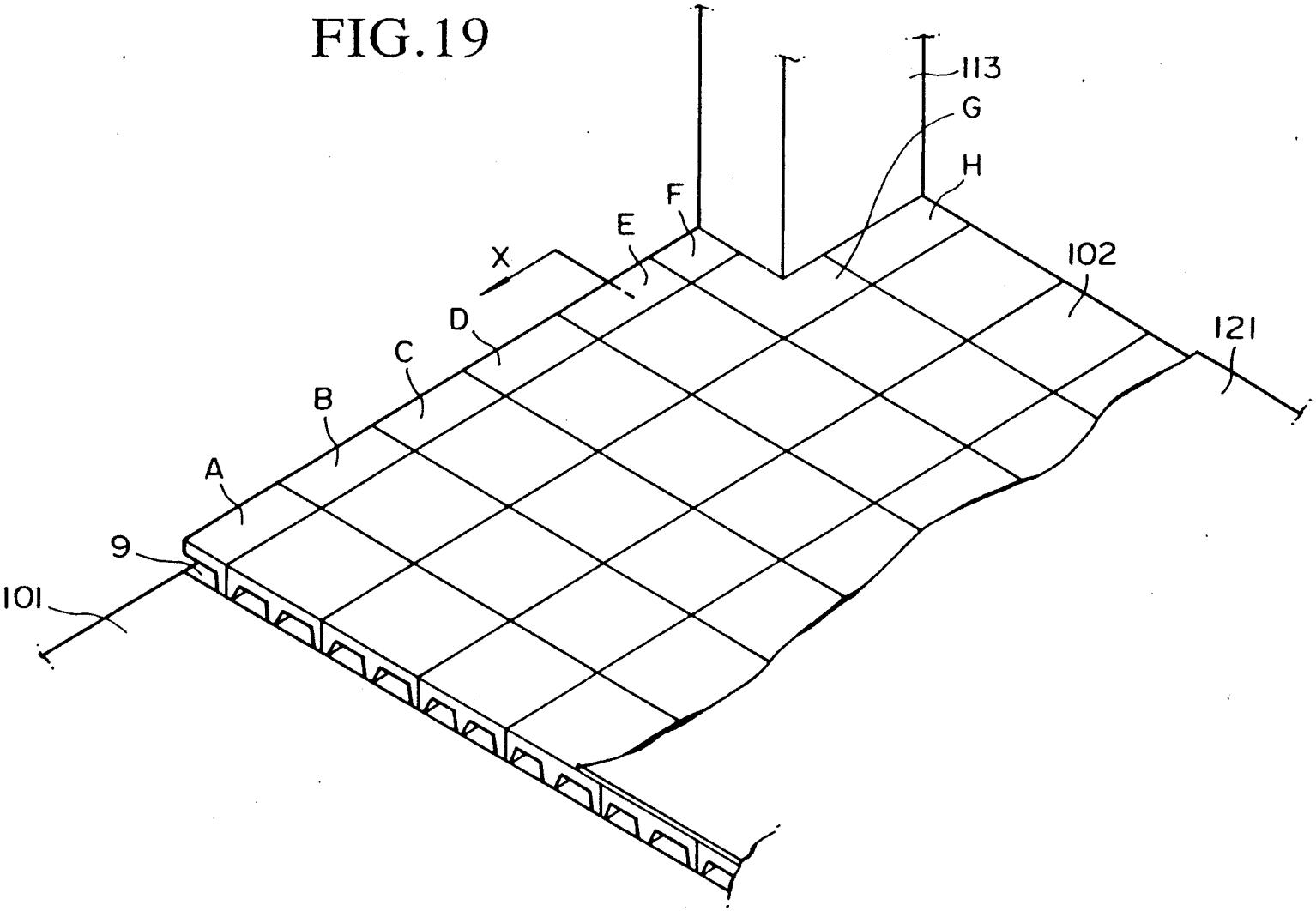
FIGS. 19 to 22 are for the purpose of explaining a double floor with a construction having support parts.
Figure 23:
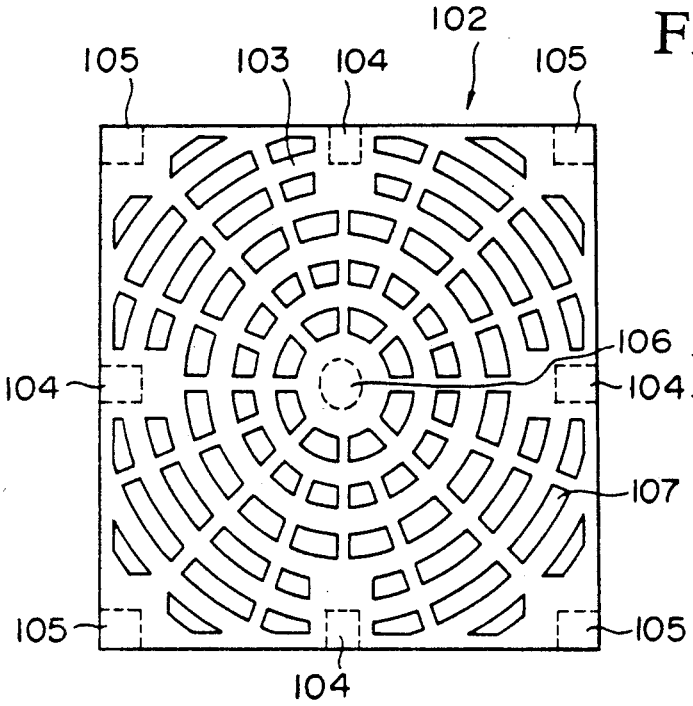
FIGS. 23–28 show panels used in a double floor with a construction having support parts or a double floor with a construction in which a number of panels of differing strengths are spread closely together, or show the shape of a rubber pad.
Figure 25:
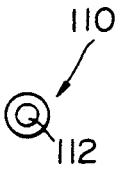
Figure 27:
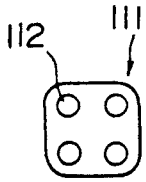
Figure 26:
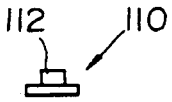
Figure 28:
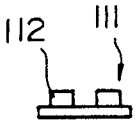
Figure 24:
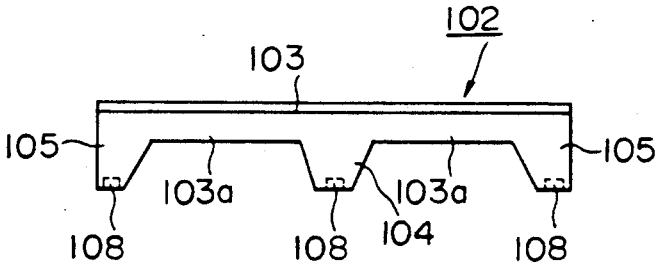

In FIG. 19, reference number 101 indicates a surface below a floor, such as a slab or the like. A plurality of panels 102 are laid upon this underlying surface 101. Panels 102 are made of a compound resin such as PP (polypropylene) or the like. As shown in FIG. 23, panels 102 comprise a square panel main body 103, on the back surface of which a plurality of ribs 103*a* are formed, and legs 104, 105, and 106, which are provided on the back surface of the panel main body 103 at the periphery and in the central part thereof. A plurality of arc-shaped slits 107 are provided on the upper surface of a panel 102, and cavities 108, into which fit protrusions 112 of rubber pads 110 and 111 described hereinbelow, are provided in legs 104, 105, and 106.

Figure 20:
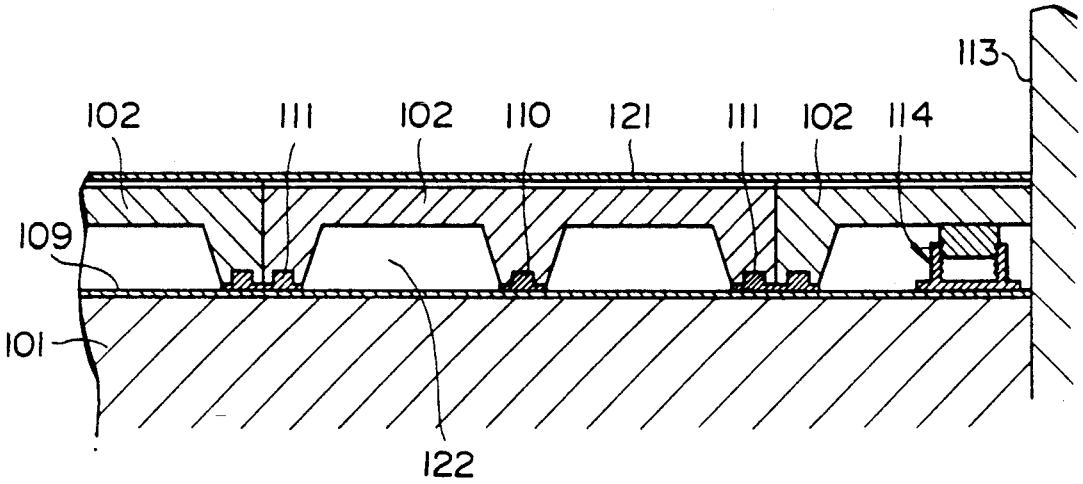

As shown in FIG. 20, these panels 102 are laid above surface 101 through the medium of rubber pads 110 and 111 on the upper surface of sheet 109, which is laid on the upper surface of underlying surface 101. Sheet 109 is, like sheet 21 described above, made of polyethylene foam and the like, so that small unevennesses in the surface 101 are absorbed, and sheet 109 is attached to surface 101.

Furthermore, rubber pads 110 and 111 have the same construction as rubber pads 16 and 17 discussed above. As shown in FIGS. 25–28, the pads have on their upper surfaces a fixed number of projections 112. These projections 112 fit into cavities 108, and thus rubber pads 110 and 111 are placed between sheet 109 and the legs of panels 102.

Within these panels 102, the panels positioned at the edge of the floor surface, in other words, the panels near the wall, indicated in FIG. 19 by A–H, are cut in correspondence with the size and shape of the floor surface so that the floor surface is consistent with the wall surface. Among these, there are items such as that marked G in the diagram, which can be installed in a stable fashion with those legs remaining after cutting and which have sufficient strength with respect to weight load/area. Aside from these, as is shown in FIG. 20, a support part 114 is inserted between panel main body 103 and sheet 109, and with the legs remaining after cutting and this support part 114, the panel is stable and has sufficient strength when installed.

Figure 21:
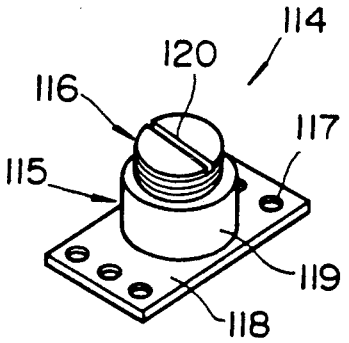
Figure 22:
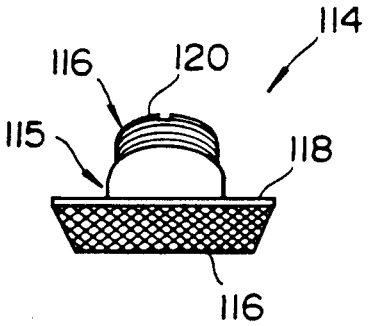

As shown in FIGS. 21 and 22, support part 114 comprises support platform 115, which is made of a compound resin such as ABS or the like, and a pipe body 116, which is screwed into support platform 115. Support platform 115 comprises a square base plate 118, in the back surface of which grooves 116 are formed in a lattice pattern, and in the periphery of which access holes 117 are formed, and cylindrical part 119, which is formed on base plate 118 in a protruding fashion and on the inside surface of which a screw thread is formed. Furthermore, a groove 120 for a tool such as a screwdriver or the like is formed on the extending end surface of pipe body 116, and a screw thread which screws into cylindrical part 119 is formed on the outer circumference of pipe body 116.

Base plate 118 is attached to sheet 109 and the extending end surface of pipe body 116 is put in contact with the rear surface of panel main body 103; thus support part 114 is placed between panel main body 103 and sheet 109. This support part 114 has, like panel 102, standardized dimensions.

It is permissible to install support parts 114 beneath a panel 102 which is not a panel such as those indicate by A–H, in order to adjust the height or increase the strength with respect to weight load/area.

Flooring materials 121 such as tile or carpet are laid and attached to the upper surface of panels 102.

A double floor with the construction given above can be installed easily in the following manner.

That is, first, sheet 109 is laid and attached to underlying surface 101, then panels 120, to the legs 104 and 106 of which rubber pads 110 have been attached, are laid on sheet 109 through the medium of rubber pads while being connected to each other by the attachment of rubber pads 111 to legs 105.

Then, panels 102 near the walls are cut, if necessary, and laid, as in the case of the panels 102 indicated by A–H, so that the floor surface conforms to the walls. At this time, support parts 114 are inserted as needed.

Support parts 114 are placed in fixed positions on sheet 109 before the laying of panels 102 and attached, and after panels 102 are laid, pipe body 116 is rotated and thus raised, and the extending end surface of pipe body 116 is brought into contact with the rear surface of panel main body 103.

The rotation of pipe body 116 can be accomplished easily by the insertion of a screwdriver or the like through the slits 107 formed in panel main body 103 and utilizing the groove 120 formed in pipe body 116 to rotate the pipe body. Furthermore, the attachment of support part 114 can be accomplished by the spreading of an adhesive on the rear surface of base plate 118 and pressing the base plate 118 into contact at a fixed position. At this time, the adhesive enters the grooves 116 or access holes 117 formed on the rear surface of base plate 118.

Support parts 114 are not limited to use beneath panels 102 that are near a wall, but can be installed in the same way as given above in such cases as the case in which the correction of sloping or warp in panels 102 as a result of unevennesses in the underlying surface 101 is desired, the case in which some of the legs of panels 120 are not in contact with sheet 109 as a result of unevennesses in the underlying surface 101, and replacement support is necessary for panels 102, the case in which an increase in the strength with respect to weight load/area of some panels 102 is desired, or the like.

Then a flooring material 121 is laid on top of and attached to the panels 102 which have been laid in this manner, and installation thus completed.

The following effects are obtained in the case of a double floor such as that described above. Only panels 102 and support parts 114 that are standardized and can be prefabricated in large amounts at a factory are used, and a double floor of a certain size and form can be easily constructed, so that even in the case of a double floor which has a special form, the construction is very simple and the costs involved in the construction are very low.

Furthermore, by the insertion of support parts 114 beneath panels 102 as necessary, even if there are unevennesses in the surface 101 beneath the floor, a floor surface which is level and which has a guaranteed strength with respect to the weight load/area can be easily constructed, and in addition, the construction of a floor surface which has localized increases in strength with respect to weight load/area can be achieved.

In the case of the present embodiment, support parts 114 are installed by placing pipe body 116 in contact with the rear surface of panel 102, and the rotation of pipe body 116 after installation is thus prevented by friction; however, in order to ensure that this rotation is prevented, it is acceptable to provide a rotation stop on pipe body 116, for example, by driving a nail or the like through panel 102 into pipe body 116.

Furthermore, in the case of the present embodiment, support parts 114 are in contact with sheet 109, but it is acceptable to either partially remove sheet 109 and put them into direct contact with underlying surface 1, or to place them on top of sheet 109 without making contact with underlying surface 101.

In addition, the form of the grooves 116 provided on base plate 118 in order to increase the contact force of support parts 114 is not limited to a lattice pattern; a pattern of concentric circles, for example, is also acceptable. Furthermore, it is acceptable to construct base plate 118 with notches instead of access holes 117.

Next, a preferred embodiment according to which a double floor is constructed using panels of differing strengths will be explained with reference to FIGS. 29 and 30.

Figure 29:
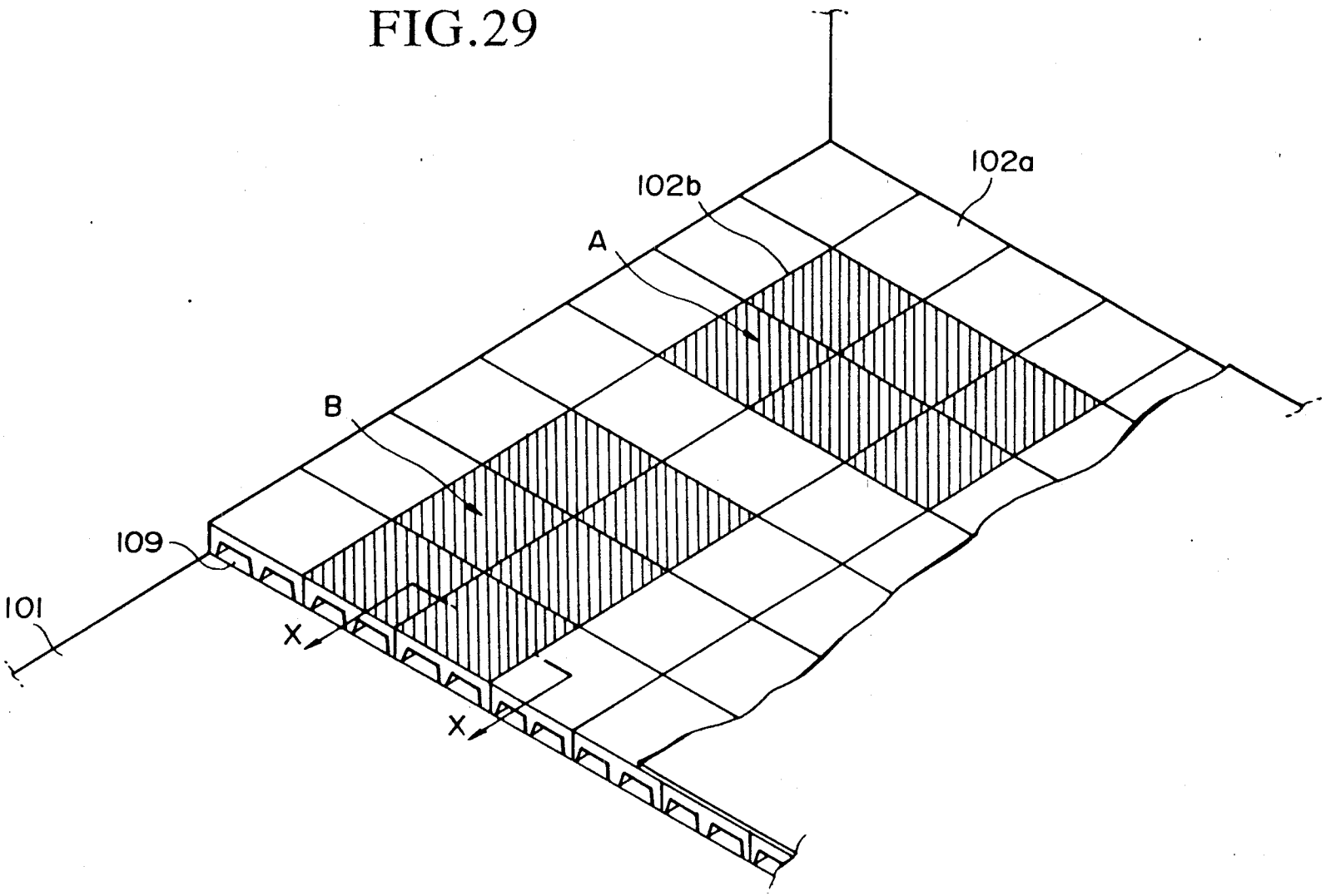
FIG. 29 is an angled view showing the overall construction of a double floor with a construction in which a number of panels having different strengths are spread closely together.
Figure 30:
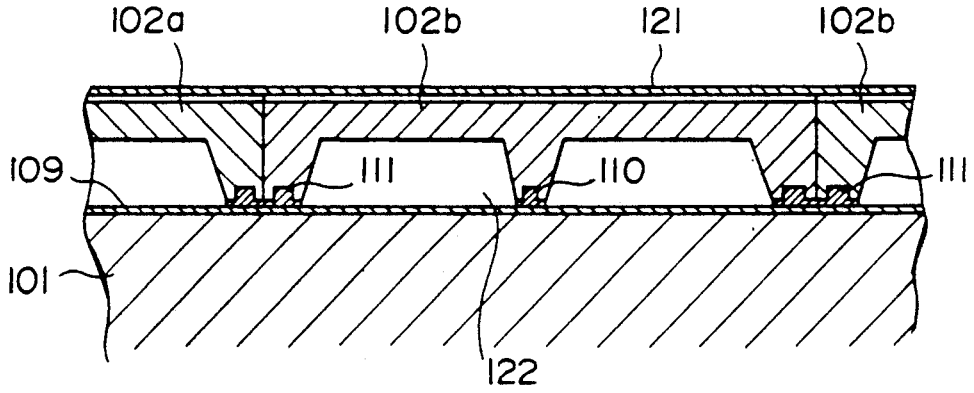
FIG. 30 is a cross-sectional view taken along X in FIG. 29.

In FIGS. 29 and 30, the references **102*a* and 102*b* indicate panels laid above an underlying surface 101**.

Panels **102*a* and 102*b* have the same shape and dimensions as panels 102 discussed above, but panels 102*a* are made from, for example, PP (polypropylene) compound resin, while panels 102*b* are formed of fiber-reinforced PP (polypropylene), so that the strengths of the two differ; they are also different colors. For example, in the case of the present embodiment, the maximum weight load of one panel is 300 kg in the case of panels 102*a* and 1500 kg in the case of panels 102*b***.

These panels **102*a* and 102*b* are, as shown in FIG. 30, laid above underlying surface 101 through the medium of sheet 109 and rubber pads 110 and 111, as in the case of panels 102** discussed above.

Of these panels **102*a* and 102*b* high-strength panels 102*b*** are used only in positions where heavy items are to be placed (in the case of this embodiment, at the positions marked A and B).

In accordance with a double floor having the above construction, it is possible to place heavy items corresponding to a weight load of 1500 kg per panel at positions A and B on the floor surface.

In other words, high-strength panels **102*b* are laid only in positions where heavy objects are placed, and low-strength, low-cost panels 102*a*** are laid where no heavy objects are to be placed, so that places of excess panel strength are eliminated and the cost of materials is kept at the lowest possible limit. As a result, the cost of constructing a double floor is greatly reduced.

Furthermore, the panels are differentiated by color according to strength. As a result, the panels are laid in set positions after their strength is identified according to color, so that mistakes in the positioning of panels are avoided. In addition, even after the construction of a double floor, the strength of each panel used in the floor surface can be checked by color, so that the mistaken positioning of a heavy object on a panel which does not have sufficient strength is avoided, and when heavy objects are repositioned, it can be visually determined whether a rearrangement of the panels is necessary.

In each of the preferred embodiments discussed above, panels 1, 31, 102, 102*a*, and 102*b* were square, but this is not necessarily so limited. Any form is acceptable so long as gaps are not created between adjoining panels when laid; for example, a rectangular form is acceptable. Furthermore, the panels are not limited to standardized dimensions; for example, it is acceptable to use two types of panels, the dimensions of which are in a 1:2 relationship.

Furthermore, it is possible to combine the four preferred embodiments above. For example, it is possible to construct a double floor of the type shown in FIGS. 19 or 29 using panels having a construction identical to that of panels 1 or 31.

What is claimed is:

1. A panel for use in double floors, having panel main body, having a rear surface which has a plurality of attachment holes formed therein, pole-shaped leg parts, having an outer circumference of which a step is formed, and an end of which fits into said attachment holes when said step faces said panel main body, elastic rings, which are placed around said leg parts and between said steps and said panel main body, and projections, which are formed around an outer circumference of an end of said leg parts, said projections being deformed by means of the insertion of said leg parts into said attachment holes, such to fill gaps between said outer circumferences of said ends of said leg parts and inner surfaces of said attachment holes.

2. A panel for use in double floors in accordance with claim 1, having attachment holes which are for the continuous attachment of parts having a construction identical to said leg parts which are formed in the other ends of said leg parts. pg,21

3. A panel for use in double floors in accordance with claim 1, wherein said attachment holes are screw holes;

said ends of said pole-shaped leg parts have screw threads screwed into said screw holes when said step faces said panel main body;

said ends of said pole-shaped legs each having an end surface with connecting grooves; and said panel main body includes an upper surface with access holes to provide access to said connecting grooves.

* * * * *